United States Patent [19]

Ford

[11] Patent Number: 4,694,916

[45] Date of Patent: Sep. 22, 1987

[54] CONTINUOUS CORING DRILL BIT

[75] Inventor: George A. Ford, Houston, Tex.

[73] Assignee: R. C. Ltd., Houston, Tex.

[21] Appl. No.: 910,389

[22] Filed: Sep. 22, 1986

[51] Int. Cl.[4] ..... E21B 10/02

[52] U.S. Cl. ..... 175/249; 175/252; 175/404

[58] Field of Search ..... 175/249, 251, 252, 253, 175/404, 250, 400

[56] References Cited

U.S. PATENT DOCUMENTS 3,086,602 4/1963 Henderson ..... 175/404

3,215,215 11/1965 Kellner ..... 175/404

FOREIGN PATENT DOCUMENTS 226607 7/1982 Argentina .

*Primary Examiner*—Stephen J. Novosad

*Assistant Examiner*—William P. Neuder

[57] ABSTRACT

A continuous coring drill bit having a body forming external lands for support of cutting elements such as industrial diamonds and grooves for conducting drilling fluid during drilling. The body further forms an internal cavity receiving a tubular core breaker in freely rotatable relation therein and also forms a central throat receiving a core as the drilling operation continues. The core breaker is provided with an internal buttress and is eccentrically mounted within the body such that rotation of the body induces lateral oscillation of the buttress causing it to fracture the core into small sections. By reverse circulation the core sections are transported upwardly through the drill string to the surface for separation from the drilling fluid and analysis by geologists.

13 Claims, 3 Drawing Figures

CONTINUOUS CORING DRILL BIT

FIELD OF THE INVENTION

This invention relates generally to drill bits for drilling earth formations such as for the production of petroleum products. More specifically, this invention relates to a continuous coring drill bit which may be of the reverse circulation type and which accomplishes continuous coring and continuous fracturing of the core as drilling continues.

BACKGROUND OF THE INVENTION

This invention relates generally to the subject matter of Argentine Pat. No. 226,607 of applicant, filed July 13, 1981 and issued July 30, 1982 for Broca Para Recuperar Muestras Geologicas.

The present invention refers to a drill bit for the recovery of geological samples, such as rocks in generally cylindrical bar form, typically referred to as a core. The geological samples are generated continuously during drilling operations and are efficiently transported to the surface for inspection by geologists at any given time during drilling operations. The continuous coring drill bit of the present invention lends itself efficiently to the use of reverse circulation of drilling fluid for accomplishing continuous drilling and coring operations.

In general terms, there are two systems for recovering geological samples, using a widely varied design for drill bits for drilling rocks. The first system, referred to as direct circulation, consists of injecting a fluid, commonly a liquid mud drilling or weighting through a length of pipe, one end of which is connected to a rotating system capable of rotating it around its long axis. The lower extremity of the rotating drill pipe is connected to the upper portion of a drill bit. The drilling fluid is injected into the bottom of the drilled hole through openings in the lower portion of the bit and returns to the surface through the annulus defined between the rotating drill pipe and the wall surface of the well bore which is being drilled.

In this direct circulation system it is necessary to continue casing the hole being drilled to insure that the particles cut from the formation are carried upwards by the fluid on its return without being plastered into the wall of the borehole. If the particles cut are very small, then the muddy and abrasive fluid acts to further reduce such particles while they are traveling to the surface along with the drilling fluid. The rotating drill pipe can engage the wall surface of the well bore during rotation and, in such event, tends to crush the drilled particles, thus further reducing them in size as they continue upwardly through the annulus. Considering that some boreholes are very deep, the excessive reduction of such rock particles make it difficult to obtain a reliable concept of the relationship of formations and the depth from which the particles originated. This provides significant problems to geologists who must interpolate the particle samples to identify the characteristics of the formation being drilled.

As the well bore nears a high pressure oil or gas production zone, it is very important that geologists be able to accurately identify the character of the formation being drilled. For this reason, well drilling operations in deep wells typically require cores to be provided for inspection by geologists. For coring, the drill pipe is removed from the well and a drilling device, typically referred to as a core barrel, is attached to the drill pipe in place of the drill bit. After drilling to a particular depth, the drill pipe and core barrel are removed from the well bore, the core barrel containing a core, which is an unbroken section of rock formation. The core is processed by geologists who assist in rendering decisions for further well drilling operations. When core barrels are employed for coring operations, the drill string must be removed from the well bore at the time the core barrel is installed and must again be removed from the well bore after the core barrel has reached a depth filling its internal chamber with core material. Obviously, frequent removal of the drill string from the well bore for coring is an expensive and time consuming operation which should be avoided if possible. Through employment of the continuous coring drill bit of this invention, it is not necessary to frequently remove the drill pipe from the well bore and yet, if the core material is proper for purposes of geological inspection, the results of coring will be quite satisfactory.

Another system for recovery of geological samples from wells being drilled is known as reverse circulation. In this case, well drilling mud or washing fluid is forced downwardly from the surface in the annulus between the rotating drill pipe and the wall surface of the well being drilled. When it reaches the bottom of the hole, it enters appropriate openings of the drill bit and then traverses upwardly through the drill pipe to the surface carrying with it drill cuttings that are removed from the formation being drilled by the rotating drill bit. For recovery of geological samples, a continuous coring-type drill bit may be employed which accomplishes formation of a core at the time of drilling and fractures the core into relatively small pieces which are transported to the surface, along with the upwardly moving drilling fluid in the drill pipe. At the surface, separators such as shale shakers are employed to separate the core material from the drilling fluid, thus permitting geologists to frequently recover core samples and analyze them for their termination of the character of the formation being drilled.

From the foregoing, it appears that the system of reverse circulation provides improved possibilities of geological investigation as it provides for the recovery of rock samples which are of large and consolidated form thus providing geologists with the capability of efficiently determining the character of the formation being drilled. Since frequent interchange of drill bits and core barrels is eliminated, the drilling operation can continue at a rapid rate and at low cost without jeopardizing the drilling operation from the standpoint of geological efficiency.

Although the continuous coring aspects of the present invention may be utilized in drilling systems of typical circulation or direct circulation where drilling fluid is forced downwardly through the drill stem to the drill bit and returns via the annulus between the drill stem and borehole wall, better geological results are obtained through use of the continuous coring drill bit of this invention in conjunction with reverse circulation. In this case, the drilling fluid is forced downwardly in the annulus between the drill stem and the wall of the borehole. As the drill bit is rotated against the formation, drilling fluid from the annulus flows past the cutting surface and enters the throat of the drill bit. It then flows upwardly through the internal cavity or passage defined by the drill bit and then flows upwardly through the drill stem to the surface. The core particles which are fractured by the floating core breaker are transported upwardly through the drill stem along with the drilling fluid. The core particles will separate out readily and continuously by the shale shaker of the drilling rig and may be obtained and analyzed by geologists at any given time in the drilling operation. The geologists are enabled thereby to continuously monitor the character of the formation being drilled. This enables the parameters of drilling operations such as mud consistency, drill bit weight, etc., to be modified as is appropriate to the specific conditions existing at the location of the drill bit.

Through employment of reverse circulation, much more efficient control of the well being drilled may be maintained in the event a gas pocket is encountered. If a quantity of gas enters a well being drilled through employment of conventional circulation of drilling fluid, the gas expands as it rises toward the surface and occupies a greater volume of space because the hydrostatic head of the drilling fluid column is reduced. This is typically known as "kicking of the well". If this situation is not carefully controlled at the time of well kicking, a blow out can occur, thus endangering equipment and personnel as well as adversely affecting the character of the producing formation. Upon employment of reverse circulation procedures, the column of expanding gas is entrapped within the drill stem which is capable of resisting high pressure and it is efficiently controllable by surface equipment. In the event a well should start kicking during drilling operations it may be simply and efficiently controlled by reverse circulation procedures where in ordinary circumstances control could be difficult or impossible.

SUMMARY OF THE INVENTION

The present invention consists of a drill bit which comprises a hollow body which is symmetrical along its long axis, with an upper section, a main section and a lower section, all disposed in coaxial relation. The body structure of the bit is provided at its upper section for threaded connection to the drill stem which rotates the bit. Cutting or scraping teeth are provided on the bottom and side portions of the lower section of the bit for cutting the formation as the bit is rotated thereagainst. These teeth, particularly for drilling hard formations, may conveniently take the form of diamonds, such as industrial grade diamonds or polycrystalline diamonds, tungsten carbide or any other suitable material of sufficient integrity for cutting hard formations.

Within the body structure, and forming a part of the flow passage for drilling fluid being forced through the bit, is provided a generally tubular core breaker. The core breaker is mounted by bearings within the body structure and is freely rotatable relative thereto. The core breaker defines a vertical axis which is located in eccentric relation with the vertical axis of the body structure. Within the core breaker device is located a projection or buttress which extends toward the center of the bit and which is provided with an inclined surface upwards to the center on its lower face. The buttress, if desired, may be integral with the generally tubular core breaker. Due to the eccentric relationship between the core breaker and the vertical axis of the drill bit, upon each rotation of the drill bit, a transverse force or bump is applied by the buttress to the core being formed by the drilling operation. This continuous transverse bumping causes the core to fracture periodically thus breaking the core into fairly large particles which typically exceed the particle size of drill cuttings resulting as the teeth are rotated against the formation. These large core particles are transported upwardly by the drilling fluid through the flow passage of the drill stem and emerge with the drilling fluid onto the shale shaker system of the drilling rig. These large core particles are easy to identify by trained geologists and may be efficiently separated from the drilling fluid and drill cuttings by the uppermost, larger screen of the shale shaker. Thus, these core particles may be efficiently gathered by geologists and inspected.

Further, by knowing the velocity of fluid flow within the drill stem, geologists are able to determine very accurately the formation level from which any of the core particles originate. In the case of conventional direct circulation drilling systems, the unevenness of the well bore walls sometimes make it difficult to identify the exact formation level from which a core originates. Thus, it is virtually necessary with direct fluid circulation-type drilling systems to provide core barrels and solid cores in order for accurate determination of the formation at the level being drilled.

The freely rotating annular core breaker is supported by roller bearings or segmented antifriction bearings located radially and by means of an upper thrust bearing. The device is also provided with seals to impede the entry of the drilling fluid into the bearings. If desired, a lubricator may be provided which supplies additional lubricating fluid or grease to the bearings.

The length of the core sections being fractured from the core depends upon the position of the inclined buttress which breaks the core material into lengths which are capable of passing through the drill stem or tubing and flowing to the surface. At the same time, it must be ensured that the broken core sections are of sufficient size for easy examination and analysis by geologists.

Drilling operations can therefore proceed continuously until the bit is worn and must be replaced. Generally, the bits are equipped with scraping elements such as industrial diamonds, tungsten carbide, etc. which are positioned by a matrix provided on the lower exterior portions of the drill bit.

BRIEF DESCRIPTION OF THE DRAWINGS

So that the manner in which the above recited features of the present invention will become apparent and can be understood in detail, a more particular description of the invention, briefly summarized above, may be had by reference to the embodiment thereof which is illustrated in the appended drawings, which drawings form a part of this specification.

It is to be noted, however, that the appended drawings illustrate only a typical embodiment of this invention and are therefore not to be considered limiting of its scope, for the invention may admit to other equally effective embodiments.

IN THE DRAWINGS

Figure 1:
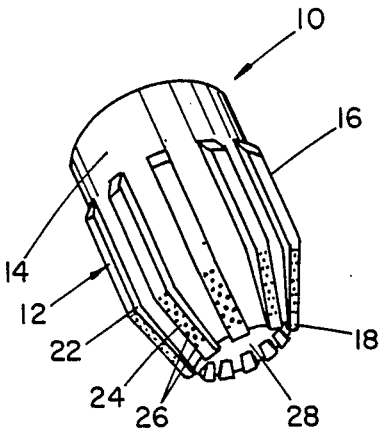

FIG. 1 is a perspective view of a drill bit contructed in accordance with the present invention.

Figure 2:
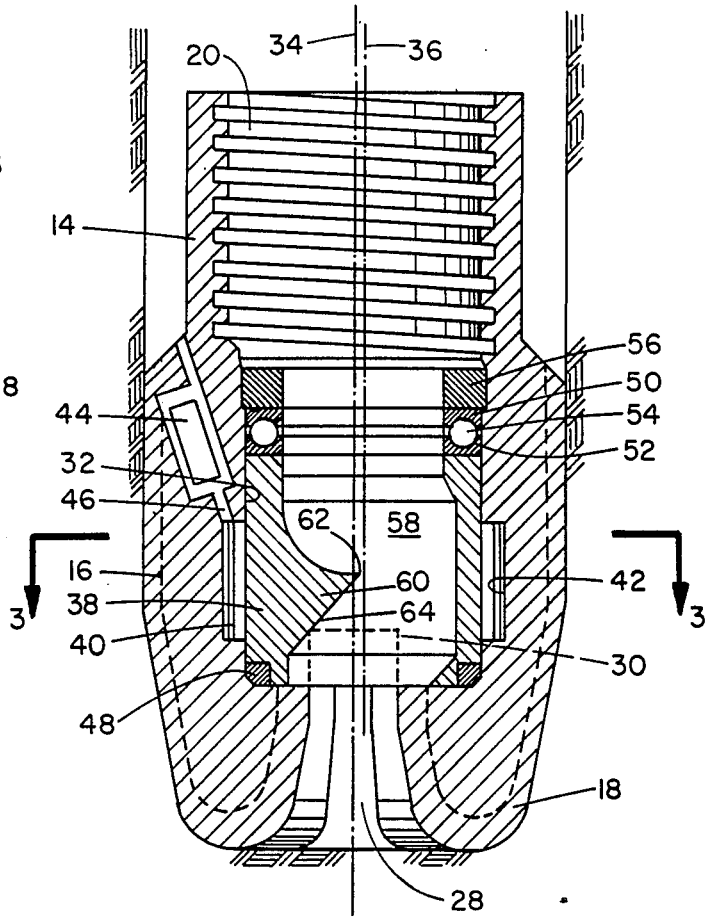

FIG. 2 is a sectional view of the drill bit of FIG. 1 illustrating the internal parts thereof in detail. By way of broken lines, a core is shown to be entering the throat of the drill bit.

Figure 3:
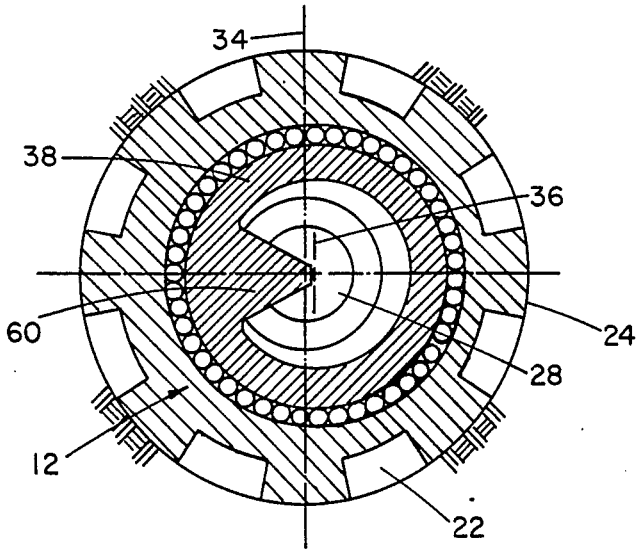

FIG. 3 is a transverse sectional view taken along line 3—3 of FIG. 2.

DETAILED DESCRIPTION OF THE PREFERRED EMBODIMENT

Referring now to the drawings and first to FIG. 1, the drill bit is shown generally at 10 and incorporates a body structure 12 having an upper section 14, an intermediate section 16 and a lower section 18. The upper section 14 is provided with internal threads 20 for threaded connection of the drill bit to the lower extremity of the drill pipe or drill stem extending from the surface to the formation level being drilled. The multiple sections of drill stem form what is known in the trade as a "drill string". The drill string is rotated and supported in such manner that the drill bit, connected to the lower portion thereof, bears against the earth formation with appropriate force for efficient drilling and long service life of the bit.

In the case of a diamond bit, such as shown in FIGS. 1 and 2, the intermediate and lower sections of the drill bit are formed externally to define a plurality of grooves 22 and lands 24. The grooves 22 provide passages for the flow of drilling fluid while the lands 24 provide support for a plurality of cutting elements 26 which, in the case shown in FIG. 4 are industrial diamonds, polycrystalline diamonds, etc. The diamonds or other cutting elements provide for cutting of the formation as the bit is rotated. The drilling fluid circulating through the adjacent grooves provide a cooling capability for the diamonds. The drilling fluid also provides for transportation of drill cuttings from the cutters into the grooves. The lower section 18 of the drill bit is of a suitable structure such that a central opening or throat 28 is defined, the throat being in communication with the various grooves defined between the external lands of the drill bit. Drilling fluid from the grooves carries drill cuttings into the throat of the bit. In the case of a continuous coring drill bit, the central throat is fairly open, thus as the bit wears away the formation, a central core remains such as shown in broken lines at 30 in FIG. 2.

Within the body structure 12 of the drill bit is defined a central cavity 32 which is of generally cylindrical form. The body structure of the drill bit, including the upper, intermediate and lower sections, defines a vertical axis 34 being the axis about which the bit rotates during drilling. The wall structure of the central cavity 32 is eccentrically located with respect to the central axis 34, being defined about an offset axis 36 which may be generally parallel with the axis 34 of the body structure.

Within the central cavity 32 is disposed a generally tubular freely rotatable core breaker element 38 which is supported for rotation relative to the housing by means of lateral thrust bearings 40. Although shown to be of the roller bearing type, received within a circular bearing groove 42, the lateral thrust bearings may take any other suitable form without departing from the spirit and scope of the present invention. If desired, the bearings 40 may be of the lubricated type, being fed lubricant from a lubricant supply 44 via a lubricant passage 46. The lubricant supply may also take any suitable form within the scope of the present invention. At its lower portion the core breaker 38 is sealed with respect to the housing by means of a circular sealing element 48 which may be composed of any one of a number of suitable sealing materials which is compatible with the drilling fluid and the temperature that is expected during drilling. The sealing element 48 prevents drilling fluid and particulate material from entering and contaminating the bearings 40.

For resistance of upwardly directed thrust on the core breaker 38 a thrust bearing system is provided which incorporates upper and lower bearing races 50 and 52 having ball bearings 54 interposed therebetween. Obviously, instead of ball bearings, the thrust bearing may conveniently take the form of roller bearings or thrust bearings of any other suitable character. The thrust bearings are retained by means of an annular bearing retainer 56 which is secured in any suitable manner within the body structure 12.

The core breaker, thrust bearings and bearing retainer cooperate to define a flow passage 58 which is of sufficient dimension to permit upward position of section of the formation core as it is fractured. These core sections may be of generally cylindrical form, developed by fracture along a horizontal plane, or, in the alternative, they may take the form of partial core sections which may be fractured other than horizontally from the core. It should be borne in mind that drilling operations are frequently conducted under circumstances where sediment lines or boundaries are positioned other than horizontally. In the case of an uplift in the subsurface earth formation, the normal fracture line of the core may be significantly inclined with respect to the horizontal. In such case, it would be typical for the core to fracture along the inclined plane forming elongated slivers of core material. The passage 58 is therefore of sufficient dimension to insure that all core sections broken from the core 30 are enabled to flow upwardly along the drilling fluid for ease of recovery at the surface. This ensures that the passage 58 will not become fouled by a stuck core section.

The core breaker 38 may be defined as a free floating core breaker. It may rotate along with the drill bit or, when engaged with the core 30, it may remain in a substantially static rotational position while the drill bit continues to rotate. In such case, due to its eccentric relation with the vertical axis of the drill bit, upon each rotation of the drill bit, the core breaker will move laterally. This lateral movement or oscillation can be effectively employed to accomplish fracturing of the core by providing a cyclical bumping effect which in time causes the core to fracture.

Within the core breaker 38 is provided an inwardly extending buttress element 60 forming a projecting surface 62 and an inclined surface 64. The inclined surface will establish engagement with the core 30 as drilling operations continue. As downward cutting of the formation occurs, and the core 30 extends further into the throat of the drill bit, it is contacted by the inclined surface 64. This contact is in the form of a transverse induced force which tends to fracture the core upon each rotation of the drill bit. The inclined surface 64 is driven against the core with the force applied to the core increasing with each rotation of the bit. As the force becomes sufficiently great to cause fracturing of the core, a section of core will be fractured away and will become entrained in the upwardly moving drilling fluid, whereupon it will be transported to the surface for separation by the shale shaker from the drilling fluid. The inclined surface 64 of the buttress actually performs a function similar to a cam to impart lateral core fracturing force to the core.

Through employment of the present invention the drill bit may be continuously rotated by the drill string while drilling fluid is circulated in reverse manner. As core fracturing occurs, the sections of core material will be transported upwardly through the drill string to surface separator equipment such as a shale shaker. The core sections will be readily recognizable by geologist personnel. Even more efficiently, the core sections are capable of ready separation from the drilling fluid such as by large screens of the shale shaker. Through employment of the present invention, drilling operations may be continuously monitored by drilling personnel and by geologists. In the event changes occur in the formation being drilled, the drilling operation may be immediately altered as is appropriate to safety and efficiency thereof. In the event high pressure gas is encountered and enters the drill stem along with the drilling fluid, it is capable of being safely contained by the pressure resistant drill string and it is capable of being efficiently controlled to insure adequate safety of the drilling operation at all times. It is therefore seen that this invention is one well adapted to attain the features and advantages hereinabove set forth together with other advantages that will become apparent from a description of the apparatus itself. It will be understood that certain combinations and subcombinations are of utility and may be employed without reference to other features and subcombinations. This is contemplated by and is in the scope of the present invention.

As many possible embodiments may be made of this invention without departing from the spirit or scope thereof, it is to be understood that all matters hereinabove set forth or shown in the accompanying drawings are to be interpreted as illustrative and not in a limiting sense.

What is claimed is:

1. A continuous coring drill bit comprising:

(a) body means defining a vertical axis and adapted for connection to drill pipe and forming an internal body cavity disposed in eccentric relation with said vertical axis and a generally circular throat in communcation with said body cavity for conducting drilling fluid, said throat defining a throat axis coincident with said vertical axis and being of a configuration permitting passage of a formation core into said body cavity;

(b) a generally cylindrical tubular core breaker being rotatably mounted within said body cavity and defining a vertical axis of rotation of generally parallel and offset relation with said vertical axis of said body means; and (c) a buttress element extending inwardly from said core breaker and adapted to contact said formation core, upon each rotation of said drill bit said buttress element applying transverse force to said core for fracturing of said core into sections sufficiently small for transport by said drilling fluid.

2. A continuous coring drill bit as recited in claim 1, wherein:

said buttress element projects transversely toward the center of said drill bit, said buttress element being positioned for fracturing engagement with said core.

3. A continuous coring drill bit as recited in claim 2, wherein:

said buttress element defines an inclined downwardly facing cam surface disposed for engagement with said core.

4. A continuous coring drill bit as recited in claim 3, wherein:

said buttress element, viewed from the vertical, is of generally triangular form and is integral with said generally cylindrical tubular core breaker.

5. A continuous coring drill bit as recited in claim 4, wherein:

said central flow passage at its narrowest region opposite said buttress element is of greater dimension than said throat and the transverse core dimension formed by said throat.

6. A continuous coring drill, bit as recited in claim 5, wherein:

(a) said body means defines external lands and grooves and a centrally located throat, said throat permitting continuous entry of a core into said core breaker during drilling operations, said grooves defining flow channels for drilling fluid and being in communication with said throat; and (b) cutting elements being provided on said lands and capable of cutting away hard earth formations as said drill bit is rotated thereagainst.

7. A continuous coring drill bit comprising:

(a) drill bit body defining a vertical axis and adapted for connection to drill pipe and forming an internal generally cylindrical body cavity eccentrically related to said drill bit body means and a core receiving throat concentric with said vertical axis and in communication with said body cavity for conducting drilling fluid, said core receiving throat being of a configuration, dimension and location relative to said vertical axis to permit passage of a formation core into said body cavity during drilling of a well bore in earth formation;

(b) a generally cylindrical core breaker being freely rotatably supported within said body cavity and defining a vertical axis of rotation of generally parallel and offset relation with said vertical axis of said body means, said generally cylindrical core breaker defining a central fluid flow passage therein; and (c) a buttress element extending from within said core breaker and projecting laterally into said fluid flow passage and adapted to contact said formation core, upon each rotation of said drill bit, said buttress element applying transverse bumping force to said core during each drill bit rotation for fracturing of said core into sections sufficiently small for transport by said drilling fluid.

8. A continuous coring drill bit as recited in claim 7, wherein:

said buttress element projects transversely toward the center of said drill bit, said buttress element being positioned for fracturing engagement with said core.

9. A continuous coring drill bit as recited in claim 8, wherein:

said core breaker defines an inclined downwardly facing cam surface disposed for engagement with said core.

10. A continuous coring drill bit as recited in claim 9, wherein:

said buttress element, viewed from the vertical, is of generally triangular form.

11. A continuous coring drill bit as recited in claim 7, wherein:

(a) said internal body cavity is defined about a vertical center line that is eccentrically related to said vertical axis of said body means;

(b) said core breaker is of generally cylindrical form defining a central flow passage and is supported within and in freely rotatable relation with said internal body cavity; and (c) said buttress element is integral with said core breaker and extends from one side of said core barrel toward the center of said body means and projects into said central flow passage.

12. A continuous coring drill bit as recited in claim 11, wherein:

said central flow passage at its narrowest region opposite said buttress element is of greater dimension than said throat and the transverse core dimension formed by said throat.

13. A continuous coring drill bit as recited in claim 11, wherein:

(a) said body means defines external lands and grooves and a centrally located throat, said throat permitting continuous entry of a core into said core breaker during drilling operations, said grooves defining flow channels for drilling fluid and being in communication with said throat; and (b) cutting elements being provided on said lands and capable of cutting away hard earth formation as said drill bit is rotated thereagainst.

* * * * *